US005709000A

United States Patent [19]

Hansen et al.

[11] Patent Number: 5,709,000

[45] Date of Patent: Jan. 20, 1998

[54] BABY PILLOW AND DROOL GUARD

[76] Inventors: Robin Hansen; John Leon, both of P.O. Box 281764, San Francisco, Calif. 94128

[21] Appl. No.: 726,343

[22] Filed: Oct. 3, 1996

[51] Int. Cl.[6] ..... A41B 13/10; A47D 15/00

[52] U.S. Cl. ..... 5/655; 2/49.1

[58] Field of Search ..... 5/655, 636, 652, 5/657; 297/393; 2/49.1, 49.4, 50, 104

[56] References Cited

U.S. PATENT DOCUMENTS

| | | | |
|---|---|---|---|
| 2,364,568 | 12/1944 | Tiscornia | 2/50 |
| 2,379,722 | 7/1945 | Kase | 2/50 |
| 2,431,052 | 4/1947 | Gier | 2/49 |
| 2,620,475 | 12/1952 | Legg et al. | 2/49.1 |
| 3,154,789 | 11/1964 | Lewis, Jr. | 2/104 |
| 4,393,520 | 7/1983 | Koch | 5/655 |
| 4,660,225 | 4/1987 | Kahn | 2/49.4 |
| 4,697,287 | 10/1987 | Rose | 2/104 |
| 4,780,911 | 11/1988 | Mack | 2/49.1 |
| 5,487,190 | 1/1996 | Thompson | 2/49.1 |

FOREIGN PATENT DOCUMENTS

| | | | |
|---|---|---|---|
| 3629554 | 4/1990 | European Pat. Off. | 2/49.4 |
| 270981 | 5/1927 | United Kingdom | 2/50 |
| 2091083 | 7/1982 | United Kingdom | 2/49.4 |

*Primary Examiner*—Alexander Grosz
*Attorney, Agent, or Firm*—Jack Lo

[57] ABSTRACT

A common way for an adult to carry a baby is to cradle the baby in both arms, so that the baby's head is resting on one of the adult's shoulders. However, the baby may drool onto the adult. Also, thin adults with bony shoulders may cause discomfort to the baby's head. Such problems are solved by a combination baby pillow and drool guard that includes a shell stuffed with soft batting. A hole is arranged on the pad, so that it may be worn around the neck of the adult. The pad covers the shoulders and upper chest area of the adult to cushion the baby's head, and to protect the adult's clothing from the baby's drool. In a first embodiment, a pair of straps connect the opposite ends of the pad together when worn. In a second embodiment, a releasable joint extends between the hole and an edge of the pad for facilitating donning and removal. In a third embodiment, the pad includes a pair of wings extending from the sides for providing extra coverage on the adult's shoulders.

1 Claim, 3 Drawing Sheets

Fig. 7

BABY PILLOW AND DROOL GUARD

CROSS REFERENCE TO RELATED APPLICATIONS

This application claims the benefit of U.S. Provisional application Ser. No. 60/004,962, filed Oct. 6, 1995.

BACKGROUND OF THE INVENTION

1. Field of the Invention

This invention relates generally to aprons, specifically to a combination baby pillow and drool guard for being worn on an adult.

2. Prior Art

A common way for an adult to carry a baby is with the head of the baby resting against the shoulder or upper chest of the adult. The comfort of the baby's head depends partly on the body shape of the adult: a muscular or fat adult provides enough padding to cushion the head; but a thin adult is bony enough in the shoulder and collarbone area to cause the baby discomfort, particularly when the adult is walking. Another problem associated with carrying a baby in this manner is that the baby would often drool onto the adult's clothing.

It is known that a conventional bath towel can be folded and draped over the shoulder of the adult to cushion the baby's head, and to serve as a drool guard. However, the towel would often shift out of position or even fall off when the baby or the adult moves, so that the position of the towel must be frequently adjusted.

OBJECTS OF THE INVENTION

Accordingly the primary object of the present invention is to provide a baby pillow and drool guard that cushions a baby's head against the shoulder and upper chest area of an adult carrying the baby.

Another object of the present invention is to provide a baby pillow and drool guard that protects the adult's clothing from the baby's drool.

Yet another object of the present invention is to provide a baby pillow and drool guard that remains securely in position even when the baby or the adult moves about.

Further objects of the present invention will become apparent from a consideration of the drawings and ensuing description.

BRIEF SUMMARY OF THE INVENTION

A baby pillow and drool guard includes a pad with a central hole through which an adult's head passes. The pad includes a shell stuffed with thick batting. The pad is sized to drape down the chest of the adult when worn, so as to cushion a baby's head and to protect the adult's clothing from the baby's drool. In a second embodiment, the baby pillow and drool guard includes a circular pad with a central head hole. A joint extends between the head hole and the edge of the pad. Hook-and-loop fasteners attached to the ends of the joint enable the joint to open and close, so as to facilitate the donning and removal of the pad. In a third embodiment, the pad includes a pair of wings extending from the sides for providing extra coverage on the shoulders of the adult.

Figure 1:
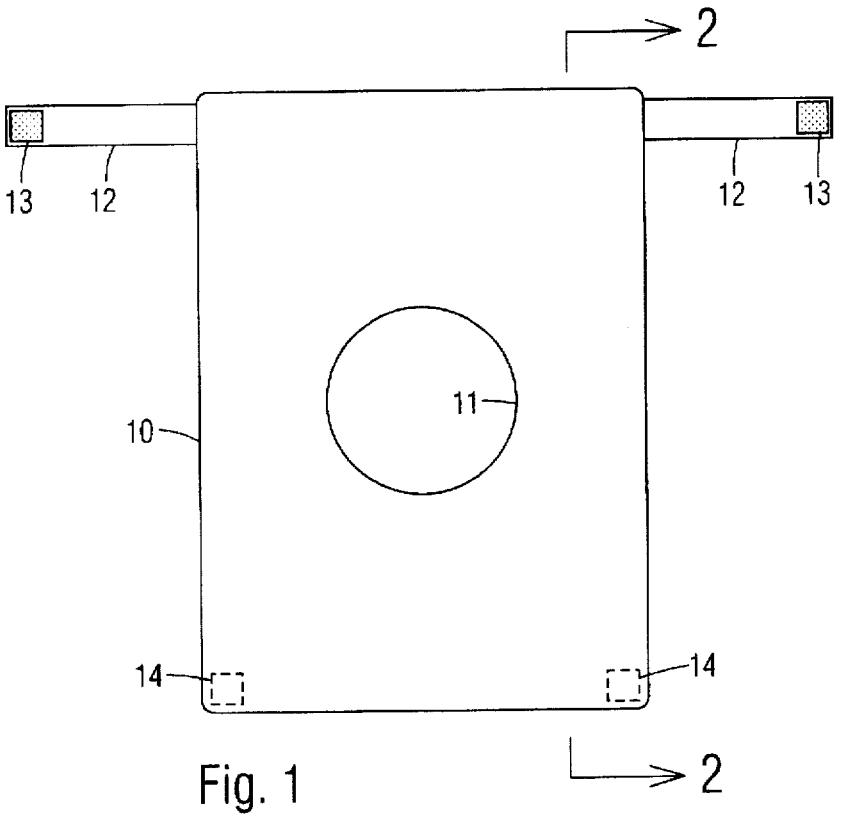
FIG. 1 is a top view of a baby pillow and drool guard in accordance with a first embodiment of the invention.

| DRAWING REFERENCE NUMERALS | |
|---|---|
| 10. Pad | 11. Hole |
| 12. Straps | 13. Hook-and-Loop Fasteners |
| 14. Hook-and-Loop Fasteners | 15. Shell |
| 16. Batting | 20. Pad |
| 21. Hole | 22. Joint |
| 23. Hook-and-Loop Fastener | 24. Hook-and-Loop Fastener |
| 30. Pad | 31. Wings |

DETAILED DESCRIPTION OF THE INVENTION

FIG. 1:

In accordance with a first embodiment of the invention shown in the top view of FIG. 1, a baby pillow and drool guard includes a flexible pad 10 with a central hole 11 sized for passing an adult's head. Pad 10 is preferably rectangular, but it may be of any other shape. A pair of flexible straps 12 extend from the comers of pad 10 at a first end thereof. A pair of first fastening means or hook-and-loop fasteners 13 are arranged on the top sides of the distal ends of straps 12. Second fastening means or complementary hook-and-loop fasteners 14 are arranged on the underside of pad 10 at the comers opposite straps 12.

Figure 2:
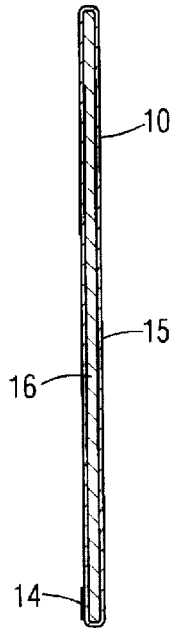
FIG. 2 is a side sectional view of the baby pillow and drool guard of FIG. 1, taken along line 2—2.

FIG. 2:

The baby pillow and drool guard is shown in a side sectional view in FIG. 2. Pad 10 includes a washable fabric shell 15 stuffed with a thick, soft batting 16.

Figure 3:
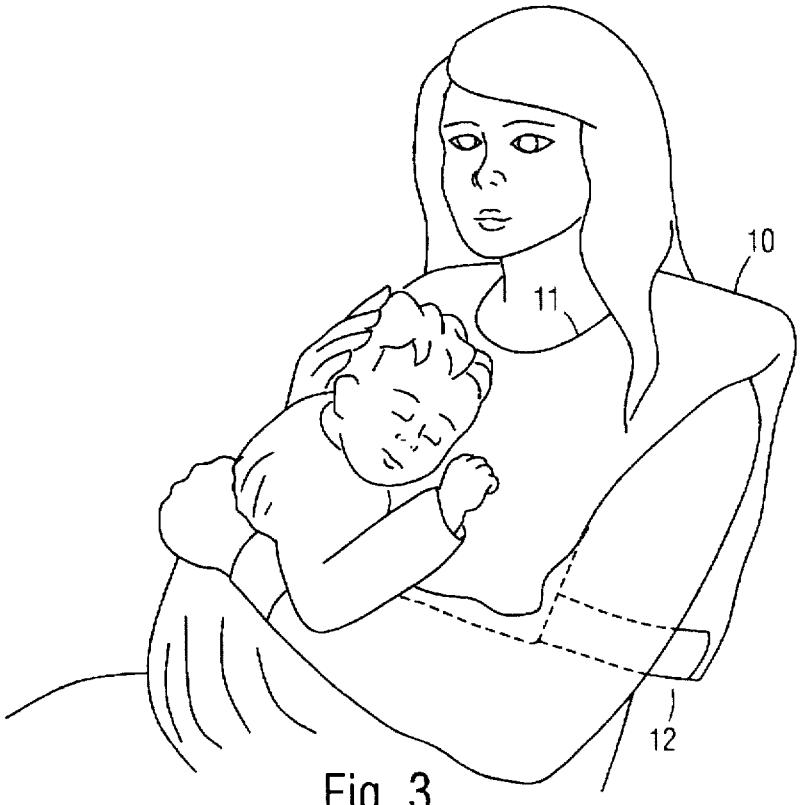
FIG. 3 is a side perspective view of the baby pillow and drool guard of FIG. 1 in use.

FIG. 3:

The first embodiment of the baby pillow and drool guard is shown in use in FIG. 3. Hole 11 is passed through the head of an adult, so that pad 10 is draped down her chest and back. The end of pad 10 to which straps 12 are fixedly attached is preferably positioned on her back. The distal ends of straps 12 are positioned under the her arms, and attached to respective hook-and-loop fasteners 14 (FIG. 1) on the opposite end of pad 10. Pad 10 is thus secured on the adult, and will not shift position or fall off even when the baby or the adult moves about. Pad 10 is thick enough to comfortably cushion the baby's head against the shoulder and upper chest area of the adult. Pad 10 is also large enough to shield the adult's clothing from the baby's drool.

Figure 4:
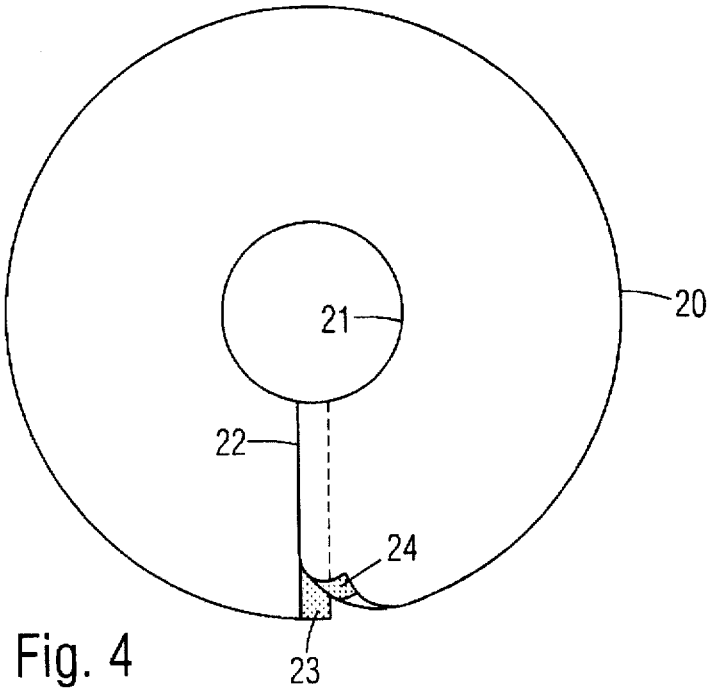
FIG. 4 is a top view of a baby pillow and drool guard in accordance with a second embodiment of the invention.

FIG. 4:

In accordance with a second embodiment of the invention shown in the top view of FIG. 4, a baby pillow and drool guard includes a flexible fabric pad 20 with a central hole 21 sized for surrounding an adult's neck. Pad 20 also includes a shell filled with soft batting (not shown). Pad 20 is preferably circular, but it may be of any other shape. A joint 22 extends between hole 21 and the outer edge of pad 20. Joint 22 includes overlapping ends with fastening means or a pair of hook-and-loop fasteners 23 and 24 arranged thereon, so that joint 22 may be easily opened and closed to facilitate the donning and removal of pad 20.

Figure 5:
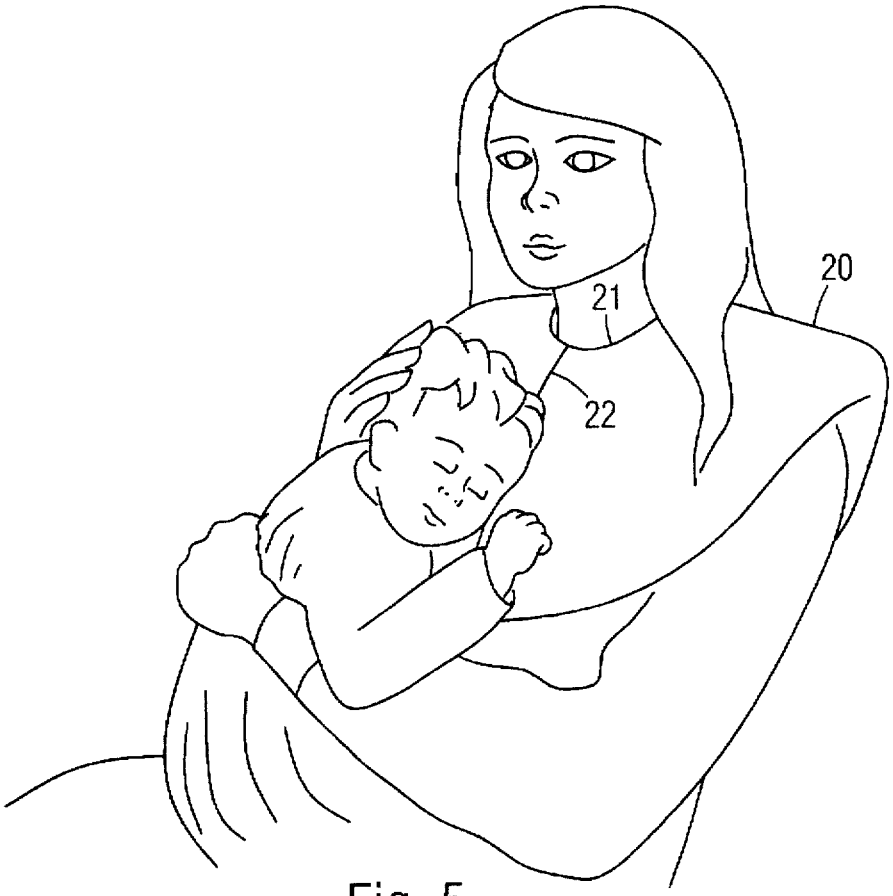
FIG. 5 is a side perspective view of the baby pillow and drool guard of FIG. 4 in use.

FIG. 5:

The second embodiment of the baby pillow and drool guard is shown in use in FIG. 5. Joint 22 is first opened, and pad 20 is positioned on an adult so that hole 21 is positioned around the neck. Joint 22 is then closed, so that pad 20 is draped down her chest and back to cushion the baby, and to shield her clothing from drool. Pad 20 is thus secured, so that it will not fall off when the baby or the adult moves about. Although pad 20 may rotate about the neck of the adult when the baby shifts position, the circular shape of pad 20 ensures that the same chest area of the adult is always covered.

Figure 6:
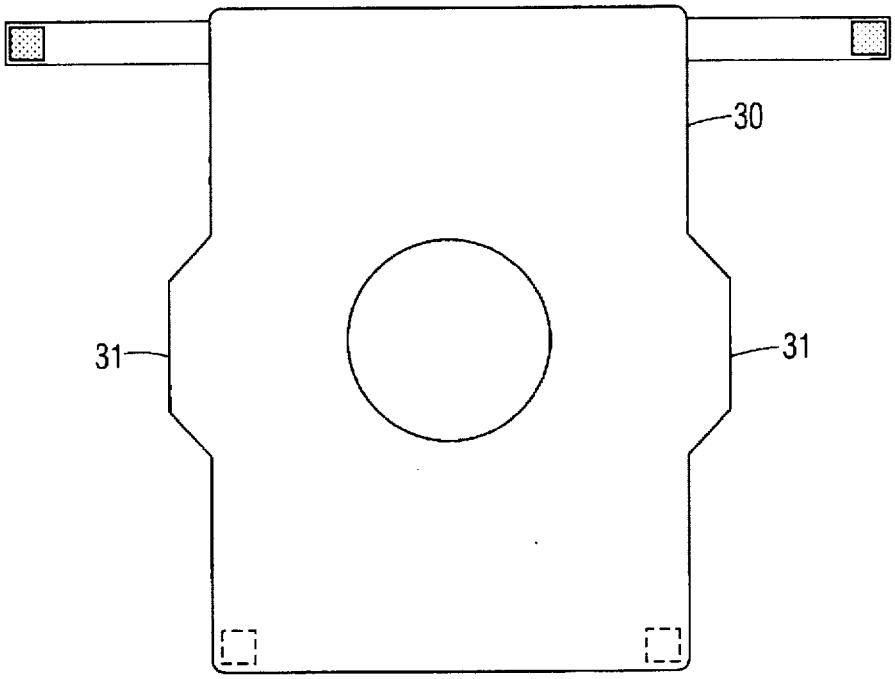
FIG. 6 is a top view of a baby pillow and drool guard in accordance with a third embodiment of the invention.

FIG. 6:

In accordance with a third embodiment of the invention shown in the top view in FIG. 6, a baby pillow and drool guard is substantially identical to the first embodiment shown in FIG. 1, except for the addition of a pair of wings 31 extending from the sides of pad 30.

Figure 7:
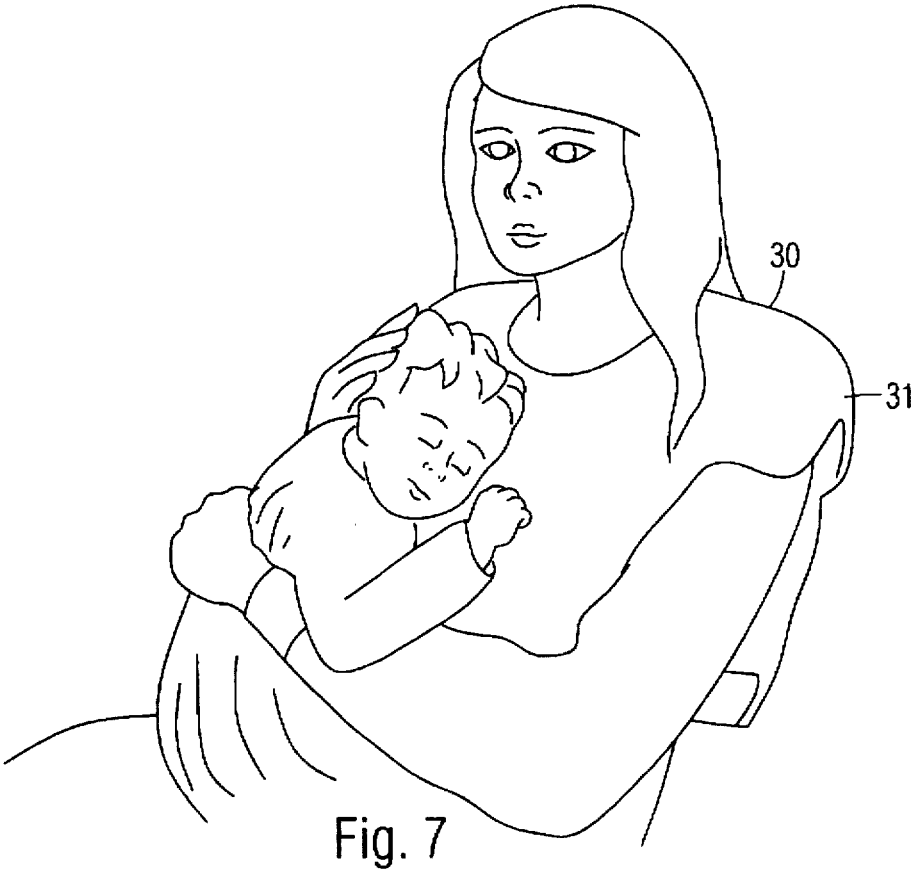
FIG. 7 is a side perspective view of the baby pillow and drool guard of FIG. 6 in use.

FIG. 7:

The third embodiment of the baby pillow and drool guard is shown in use in FIG. 7. Wings 31 (one shown) drape over the shoulders of the adult for providing extra cushioning and drool protection thereto.

SUMMARY AND SCOPE

Accordingly, we have provided a baby pillow and drool guard that comfortably cushions a baby's head against the shoulder and upper chest area of an adult carrying the baby. It protects the adult's clothing from the baby's drool, and it remains securely in position even when the baby or the adult moves about.

Although the above descriptions are specific, they should not be considered as limitations on the scope of the invention, but only as examples of the embodiments. Many substitutes and variations are possible within the teachings of the invention. For example, the pad may be made of various flexible materials, and the batting therein may be eliminated. The straps may be elastic bands, or include adjusting buckles for fitting adults of different sizes. The size of the hook-and-loop fasteners on the first embodiment of the pad may be enlarged, and the straps may be lengthened, so that the straps can be adjustably attached for fitting adults of different sizes. Also, in the first embodiment, the portion of the pad that extends down the back of the adult may be eliminated, and the straps extended to reach from the head hole down to the end of the front portion of the pad. In the second embodiment, the joint may be closed with a zipper, buttons, or other fastening devices. In the third embodiment, the wings may be of other shapes and sizes. Therefore, the scope of the invention should be determined by the appended claims and their legal equivalents, not by the examples given.

We claim:

1. A combination baby pillow and drool guard for being worn on a person carrying an infant in at least one arm, with a head of the infant leaning against the person, comprising:

a flexible pad having first and second ends, and opposite sides, said pad comprising a hollow shell enclosing soft batting therein for providing a comfortable resting surface for the infant;

a hole extending through said pad;

a pair of straps extending from said opposite sides of said pad at said first end, said straps having distal ends;

a pair of hook-and-loop fasteners arranged on said distal ends of said straps, and a complementary pair of hook-and-loop fasteners arranged on respective sides of said second end of said pad; and a pair of wings extending from said opposite sides of said pad, said pad being wearable on the person by passing a head of the person through said hole until said pad is supported on a pair of shoulders of the person, said pad being secured on the person by fastening said distal ends of said straps to said respective sides of said second end of said pad, said pad being sized to cover the shoulders and upper chest area of the person, so as to cushion the head of the infant, and to protect the person from drool from the infant, said wings being positioned for covering additional areas on the shoulders of the person.

* * * * *